US005416404A

United States Patent [19]

Baldwin

[11] Patent Number: 5,416,404

[45] Date of Patent: May 16, 1995

[54] EXTREMELY LOW POWER ZERO CROSSING CIRCUIT

[75] Inventor: John R. Baldwin, Newtown, Conn.

[73] Assignee: Hubbell Incorporated, Orange, Conn.

[21] Appl. No.: 216,945

[22] Filed: Mar. 24, 1994

[51] Int. Cl.[6] ..... G05F 1/10

[52] U.S. Cl. ..... 323/235; 323/236

[58] Field of Search ..... 323/235, 273, 275, 282, 323/285, 236; 307/130, 141, 141.4; 361/6, 183, 186, 195

[56] References Cited

U.S. PATENT DOCUMENTS

| | | | |
|---|---|---|---|
| 3,890,562 | 6/1975 | West | 323/235 |
| 4,574,200 | 3/1986 | Racca et al. | 323/236 |
| 4,626,698 | 12/1986 | Harnden, Jr. et al. | 307/38 |
| 4,864,157 | 9/1989 | Dickey | 307/135 |
| 5,072,170 | 12/1991 | Crane et al. | 323/235 |
| 5,267,120 | 11/1993 | Graff et al. | 361/185 |

*Primary Examiner*—Steven L. Stephan
*Assistant Examiner*—Matthew V. Nguyen
*Attorney, Agent, or Firm*—Jerry M. Presson; Vincent J. Sunderdick

[57] ABSTRACT

A circuit for operating relay contacts is based upon the utilization of an AC line zero voltage to provide a relay contact closure. The circuit is inexpensive and draws extremely low current levels. The circuit involves a latching arrangement of gates responsive to a zero crossing detector and a Delay Time output from a sensor. The gating circuits function in a latching arrangement which has an adjustable output to energize a relay and in turn provide for the closing of contacts which occurs substantially at zero voltage.

16 Claims, 4 Drawing Sheets

EXTREMELY LOW POWER ZERO CROSSING CIRCUIT

BACKGROUND OF THE INVENTION

1. Field of the Invention

The present application relates to a power supply for improving relay contact life by controlling current intensive gas discharges which erode relay contacts.

2. Discussion of Background

Arcing of switch contacts upon opening or closing is due to a current intensive gas discharge. The arc erodes the contacts and can significantly reduce the life of the contacts. The prior art treated these problems by using suppression networks, e.g. resistor/capacitor networks, varistors, SCR's, triac/optocoupler networks, and similar devices. These approaches contribute, in varying degrees, toward a reduction of contact erosion. Some add considerable expense to the circuit while others help mainly for lower contact current levels. This is particularly important in many consumer devices which utilize relay contacts to switch large current loads but have only milliampere or microampere circuit supply currents available.

SUMMARY OF THE INVENTION

Accordingly, it is an object of the present invention to provide for a switching device operating on extremely low currents and controlling relatively large switch loads by utilizing an inexpensive zero crossing power supply.

It is a further object of the present invention to provide a power supply system in conjunction with a controlled delay function responsive to detected zero crossing of an alternating current.

It is further an object of the present invention to provide a zero crossing power supply for operation with a miniature infrared wall switch operating at extremely low currents and responsive to outputs from infrared detectors.

These and other objects are accomplished by a zero crossing power circuit having a cross-coupled gate structure operating in response to zero crossings of the alternating current and the functioning of a delayed detector sensor output in order to provide a contact closing of a relay at an alternating current zero crossing.

It is a further object of the present invention to provide the option of a contact relay energization time which is modifiable in response to a specific relay model or even to accommodate production variations in a relay model's energization time.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
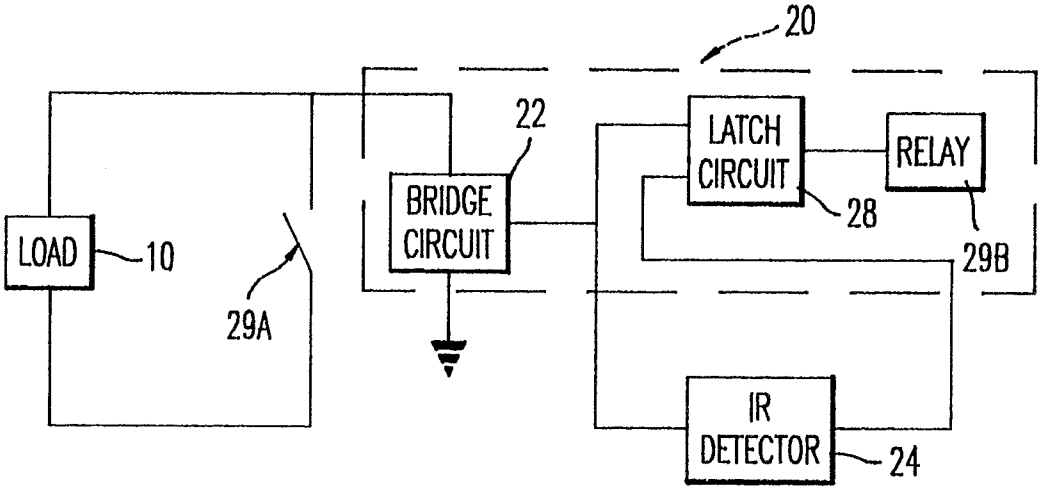
FIG. 1 is a block diagram showing the interconnection of a zero crossing power supply according to the present invention used in conjunction with the operation of a relay.

Referring now to the drawings, wherein like reference numerals designate identical or corresponding parts throughout the several views and more particularly to FIG. 1 thereof, there is shown, in block form, the integration of the zero crossing power supply 20 with an infrared detector board 24 in order to provide for closing of the contact 29*a* through operation of relay coil 29*b*.

The load 10 consisting of a light or other device is switched by the closing contact 29*a* to complete the circuit. The closing of the contact 29*a* through the operation of relay coil 29*b* is controlled in response to a detection of zero crossing points of the AC voltage by the full wave rectification bridge 22 whose output is fed to the latch circuit 28 and to the infrared detector board 24. The output of the infrared detector board is a Delay Time signal fed to another input of the latch circuit. The latch circuit 28 functions to provide a contact closure at approximately the next line zero crossing. The latching arrangement also functions to prevent cycling of gates within the power supply and also prevents IC gate through-currents from increasing the average current drain of the circuit thus enabling the circuit to typically draw an average of 15 microamperes or less, This arrangement provides the ability to switch high load levels with a low current level and an inexpensive arrangement for the zero crossing structure.

Figure 2A:
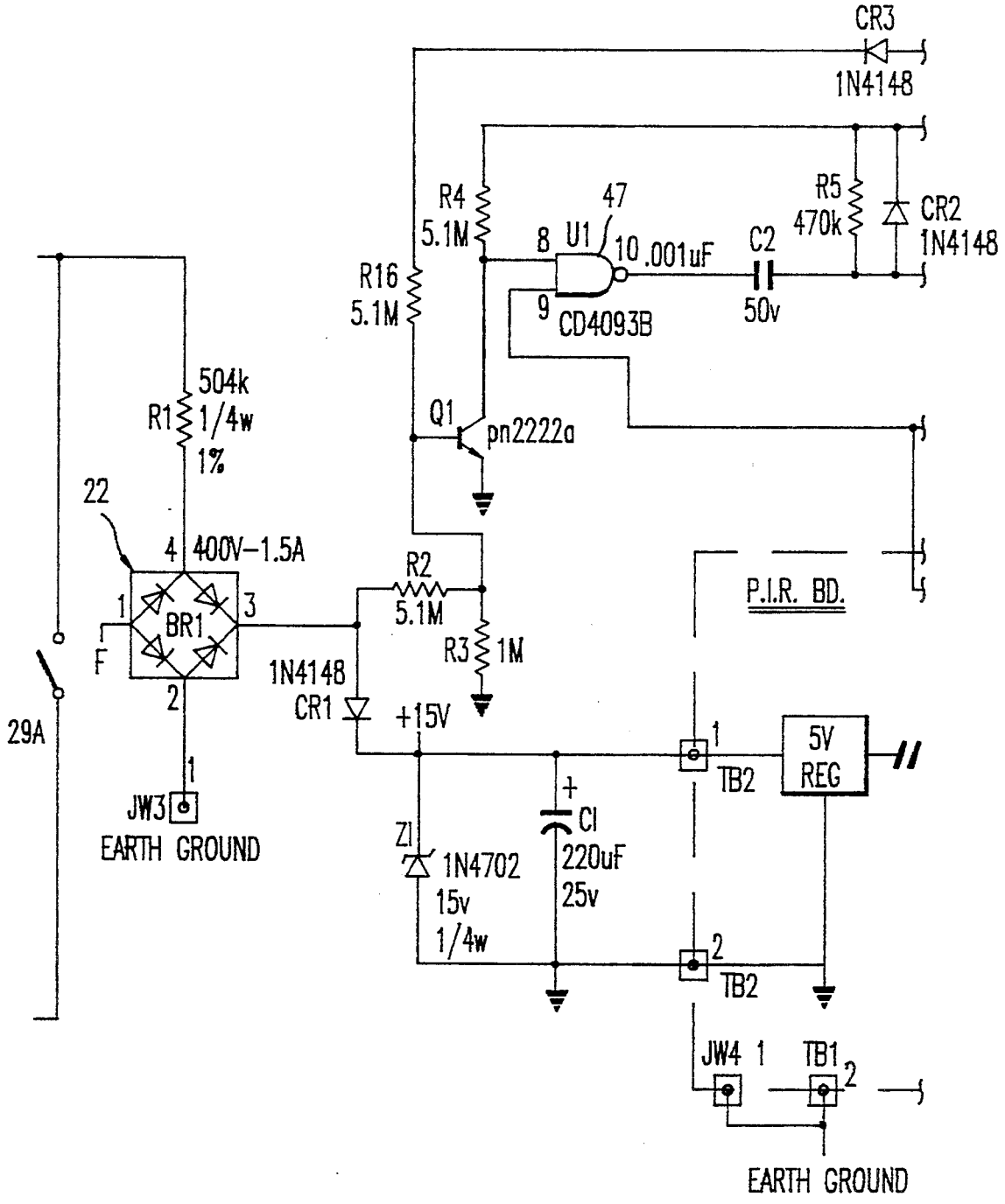
FIG. 2 is a schematic of the zero crossing power supply according to the present invention integrated into an infrared detection system.
Figure 2B:
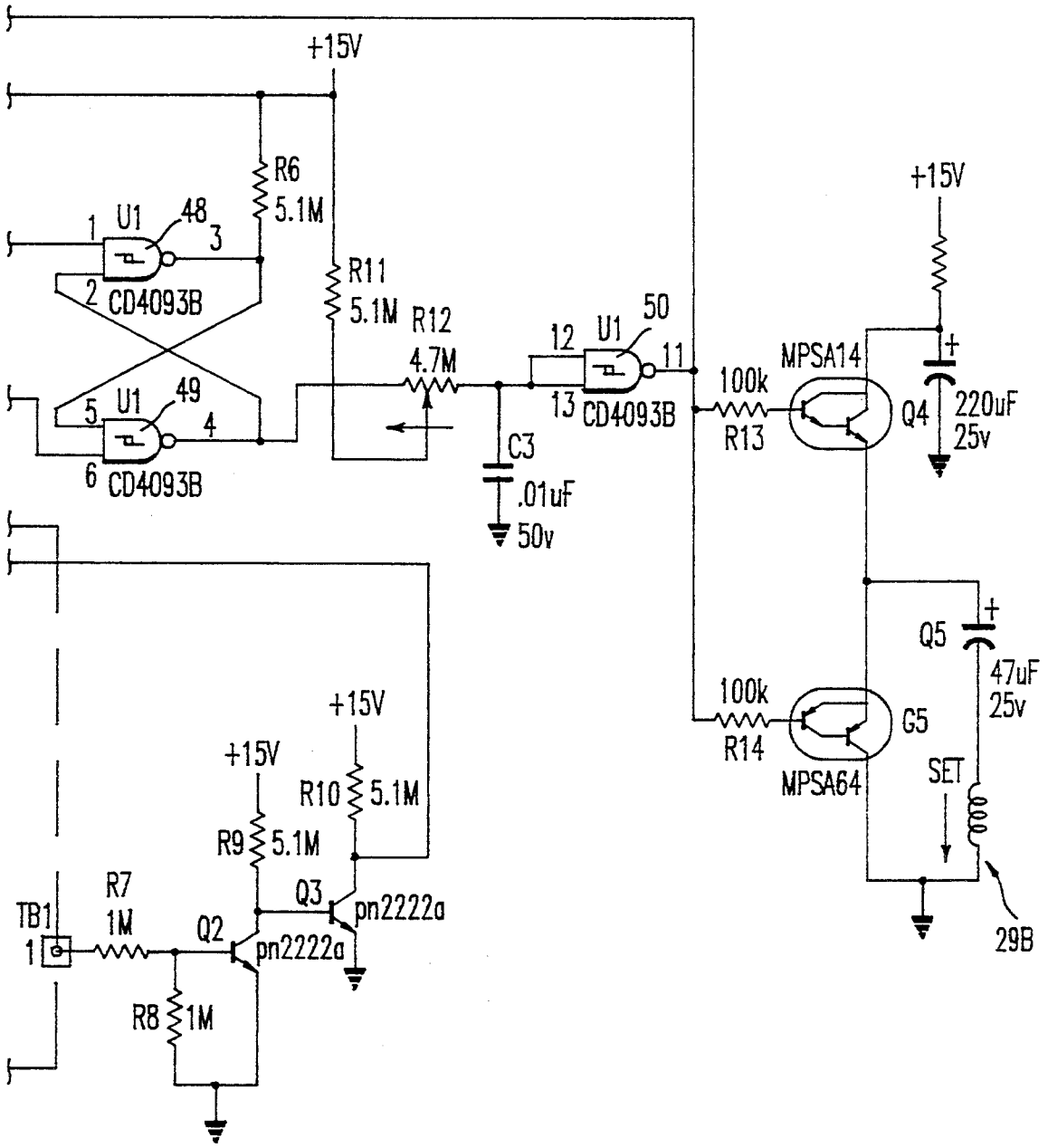
Figures 3A, 3B, 3C, 3D, 3E, 3F, 3G:
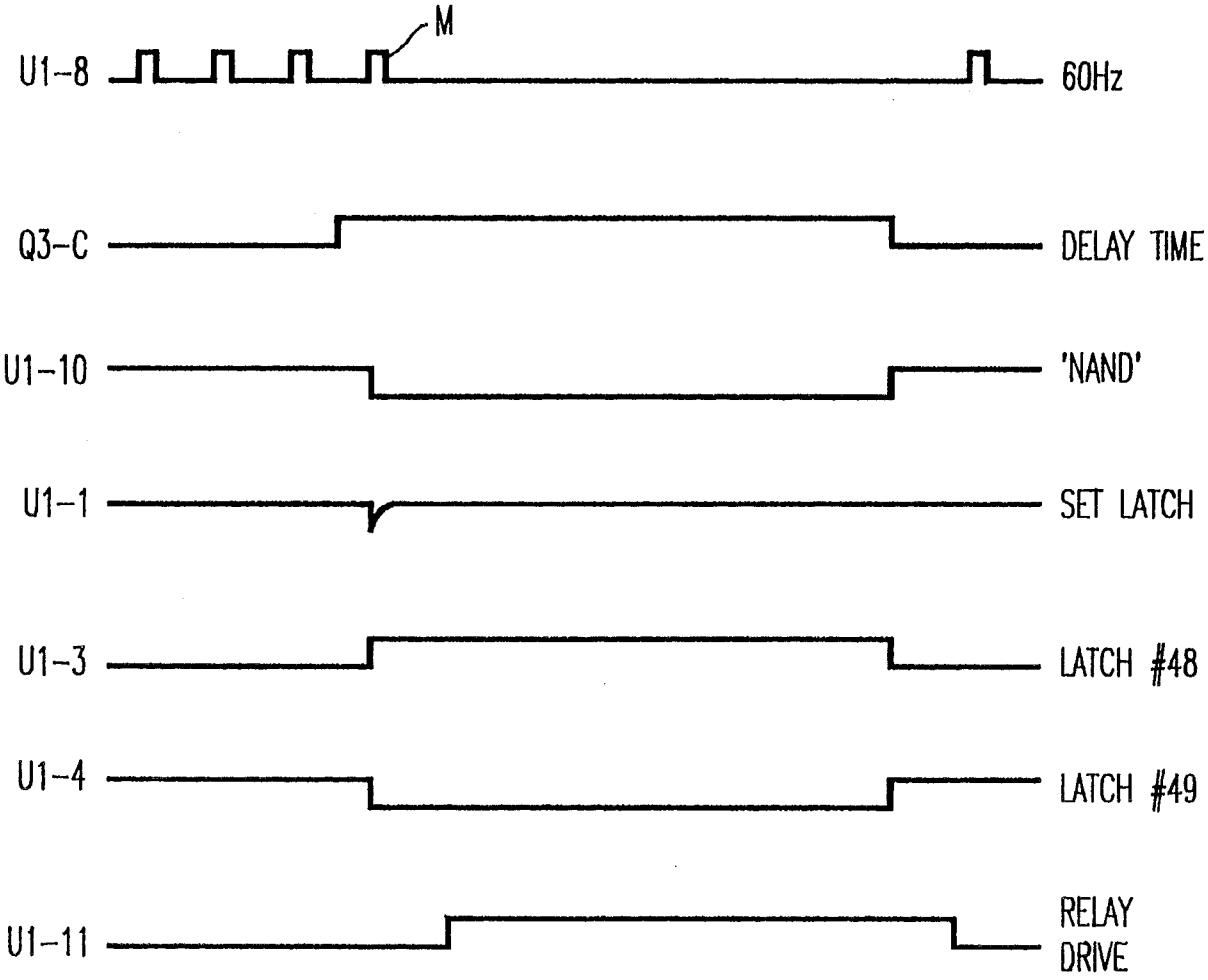
FIGS. 3*a–g* illustrates signals occurring at various points in this schematic circuit of FIG. 2.

The FIG. 2 details the schematic circuit of a preferred embodiment wherein an AC line is fed through a resistor R1 to the full wave rectified bridge 22. The output 3 of the full wave rectified bridge 22 is zero when there is a zero value of the AC voltage i.e., a zero-crossing. The output 3 of the bridge 22 is fed through resistors R2 and R3 to the base of the transistor Q1 so that Q1 is turned off only for a brief period of time when the full wave rectified output of bridge circuit 22 falls close to zero at the AC zero crossing. Thus Q1 provides a stream of 60 Hz pulses (PRR=120 Hz) into the input 8 of U1 gate 47 through the collector of Q1. The pulses are generated each time Q1 is turned off during a zero crossing. Nand gate 47 output(U1-10) is held "high" by the "low" input from the Q3 collector as shown in FIG. 3*c*. The signal at U1-10 (FIG. 3*c*) goes low at the start of the first zero crossing pulse (M) occurring within the Delay Time (when Q3-*c* is "high"), as shown in FIG. 3*b*. Because of the arrangement of the resistor R4 and the capacitor C2 and the diode CR2, the negative transition of the signal U1-10 of FIG. 3*c* causes a negative transition on the input U1-1 as shown in FIG. 3*d*. The exponential rise at U1-1 of FIG. 3*d* is a function of the time constant determined by C2 and R5. This negative transition at U1-1 will SET the latch consisting of the combination of the two cross-coupled gates 48 and 49.

The latch setting shown in the FIG. 3*e* is latch 48 output U1-3 which goes high at the start of the 60 Hz pulse M. At the same time, latch 49 output U1-4, shown in FIG. 3*f*, goes low. Once the latch output U1-4 goes low a time starts which is determined by the resistor R12 and the capacitor C3 on the output of gate 49. At the end of this particular R12 and C3 time, U1-11 which is the output of the gate 50 goes high, as shown in FIG. 3*g*. When U1-11 goes high, the relay is energized (SET)

when Q4 turns on and closes contacts 29*a*. The time delay, determined by R12 and C3, is set to result in contact closure at the nearest upcoming AC line zero crossing which would follow after the pulse M. There is no pulse to U1-8 after the pulse M because when U1-11 goes high it also, in addition to energizing the relay 29*b*, forces Q1 into a continuous ON state by means of the diode CR3 and the resistor R16. Once Q1 is in the ON condition there will be no more pulses U1-8. This prevents cycling of the U1 gates 47–49 and prevents through-currents from increasing the average current drain of the circuit.

At the end of the delay time of FIG. 3*c* the latch formed by the gates 48 and 49 is RESET by means of a negative transition from signal Q3-*c* of FIG. 3*b*, i.e., at the end of the delay time. This negative transition acts on the input U1-6 of gate 49. Once this negative transistor occurs the entire circuit is returned to its original set up and awaits a new Delay Time signal (FIG. 3*b*).

The circuitry associated with the passive infrared board 24 includes inputs TB2-2 and TB2-1 from the rectifier bridge 22 through the diode CR1, the Zener Z1 and the capacitor C1. Also shown is the 5 volt regulator. The output TB1-1 is fed through the combination of the resistors R7 and R8 to turn ON transistor Q2 and to turn OFF transistor Q3 through the biasing provided by the source of 15 volts and the resistors R9 and R10. Thus the board 24, upon detection of motion, for example, provides the Delay Signal Q3-*c* of FIG. 3*b* to SET the latch circuits 48 and 49 through the gate 47 whereas the negative transition or end of the Delay Signal Q3-*c* RESETS the latch circuit through the input U1-6 of the gate 49. Therefore, the negative transition of the gate 47 at the output U1-10 causes a SET of the latch at the input U1-1 of FIG. 3*d* having a time constant determined by R12 and C3 to provide output U1-11 which turns ON the relay 29*b* and at the same time forces Q1 to be continuously ON to stop the pulses at U1-8 of the gate 47 which prevents the cycling of the gates and also prevents through-currents from increasing the average current drain of the circuit.

As a result large loads are able to be switched using an inexpensive zero-crossing circuit at extremely low current levels with the circuit of the preferred embodiment typically drawing 15 microamperes or less.

Obviously the above described circuit could be used either to close the contact 29*a* or to open the contact 29*a* on zero crossing or with modification on both open and close. As a result of tests to determine the comparative value of a zero crossing contact closure with random opening or a random closure with zero crossing opening or a zero crossing contact closure with zero crossing opening, it has been found that a zero crossing contact closure with random opening results in the most performance for the least investment in circuitry, for incandescent loads. Incandescent loads are more demanding than fluorescent loads.

The contact closure for an incandescent load can be up to 40° from the zero crossing and still accomplish its intended function keeping the peak current equal to or less than what it would be with a precise zero crossing. This is extremely significant because once the energization time for a specific relay is known, the values of R12 and C3 can be selected to accommodate production variations in the relay energization time, i.e., no adjustment potentiometer is required during production for a specific kind of relay.

Although the illustrated preferred embodiment provides for zero crossing contact closure because of the maximizing of performance for the least investment in circuitry, the same or substantially similar circuitry could provide for contact opening at zero crossing or a combination of both opening and closing at zero crossing.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A relay energizing circuit for controlling application of AC power to a load, said circuit comprising:
   - a zero-crossing circuit responsive to said AC power to provide a zero-crossing output indication signal each time said AC power source has a value of zero volts;
   - a detector providing a detector delay time signal;
   - a first gate means responsive to said zero-crossing indication signals and to said detector delay time signal in order to provide a first gate output;
   - latching means responsive to said first gate output and said detector delay time signal to provide a drive signal output; and
   - relay means responsive to said drive signal to control application of said power to said load, wherein said power is applied to said load at a time substantially corresponding to the value of said AC power being zero volts.

2. The circuit according to claim 1 wherein said detector is an infrared detector.

3. The circuit according to claim 1 wherein said latching means comprises two cross-coupled gates.

4. The circuit according to claim 1 wherein said zero-crossing detector includes a full or half wave rectifier circuit.

5. The circuit according to claim 1 wherein said drive signal controls said first gate means to provide a constant input signal.

6. The circuit according to claim 1 further including a first resistor-capacitor connection responsive to the output of said latching means to delay said drive signal output by a value substantially corresponding to the time between zero crossings minus the energization time of said relay.

7. The circuit according to claim 1 wherein the end of said detector delay time signal triggers said latch means to stop said drive signal.

8. The circuit according to claim 1 wherein said load is an incandescent lamp or a fluorescent lamp.

9. The circuit according to claim 1, wherein said drive signal output sets said relay to close a contact to thereby provide said power to said load.

10. The circuit according to claim 1 wherein said drive signal controls said latch means to prevent cycling of said first gate and to prevent through-currents from greatly increasing current drain of said circuit.

11. A method for controlling application of AC power to a load, said method comprising the steps of:
   - detecting each zero crossing of said AC power and providing a zero crossing output signal;
   - outputting a detector delay time signal;

combining said zero-crossing output signal and said detector delay time signal to output a relay control signal;

modifying said relay control signal by delaying said relay control signal for a predetermined period of time which predetermined period of time is a function of the operation characteristics a relay; and feeding said delayed relay control signal to said relay to effect closure of a switch and the application of AC power to the load.

12. A lower power zero-crossing circuit for detecting zero-crossing of AC power, comprising:

a detector providing a detector signal;

a latching means responsive to each occurrence of a zero value of said AC power and responsive to said detector signal to provide a control signal;

feedback means responsive to said control signal to control said latching means during the extent of said detector signal and independent of zero-crossings of said AC power during the extent of said detector signal; and means for providing a predetermined time delay of said control signal which said predetermined time delay is independent of the operation of said latching circuit and said zero-crossing of said AC power.

13. The circuit according to claim 12 wherein said latching means comprises at least two cross-coupled gates.

14. The circuit according to claim 12 further comprising a full wave or half wave rectifier circuit for detecting said zero crossings of said AC power.

15. The circuit according to claim 12 further comprising a sensor means for outputting said detector signal.

16. The circuit according to claim 12 wherein the average current drawn from said AC power by said circuit is 15 microamperes (average) or less.

* * * * *